United States Patent [19]

Schreiber

[11] 4,298,493

[45] Nov. 3, 1981

[54] METHOD FOR RETARDING GELATION OF BICARBONATE-CARBONATE-SILICATE CRUTCHER SLURRIES

[75] Inventor: Ronald S. Schreiber, Highland Park, N.J.

[73] Assignee: Colgate-Palmolive Company, New York, N.Y.

[21] Appl. No.: 81,799

[22] Filed: Oct. 4, 1979

[51] Int. Cl.[3] ..... C11D 7/12; C11D 7/14; C11D 11/02; C11D 17/06

[52] U.S. Cl. ..... 252/135; 252/91; 252/174.14; 252/174.19

[58] Field of Search ..... 252/135, 174.14, 174.19

[56] References Cited

U.S. PATENT DOCUMENTS

| | | | |
|---|---|---|---|
| 3,594,323 | 7/1971 | Taylor et al. | 252/526 |
| 3,801,511 | 4/1974 | Lemoff | 252/135 |
| 3,893,955 | 7/1975 | Hewitt et al. | 252/551 |
| 3,915,903 | 10/1975 | Wise | 252/552 |
| 4,075,117 | 2/1978 | Morton et al. | 252/135 |

FOREIGN PATENT DOCUMENTS

| | | | |
|---|---|---|---|
| 2003913 | 3/1979 | United Kingdom | 252/91 |

*Primary Examiner*—Dennis L. Albrecht
*Attorney, Agent, or Firm*—Richard N. Miller; Murray M. Grill; Herbert S. Sylvester

[57] ABSTRACT

Gelation and setting of desirably miscible and pumpable crutcher slurries of sodium carbonate, sodium bicarbonate and sodium silicate in an aqueous medium are prevented by addition to such medium of a small proportion of citric acid and/or water soluble citrate. The addition of the particular gelation preventive material lengthens the workable crutching time to up to four hours, from times as little as a minute or less.

16 Claims, No Drawings

METHOD FOR RETARDING GELATION OF BICARBONATE-CARBONATE-SILICATE CRUTCHER SLURRIES

The present invention relates to preventing gelation of aqueous slurries of inorganic salt mixtures. More particularly, it relates to preventing gelation, excess thickening and setting up of bicarbonate-carbonate-silicate slurries, from which particulate heavy duty synthetic organic detergent compositions are made.

Synthetic organic detergent compositions in free flowing particulate (usually bead) form, are well known heavy duty laundry products. Up until about forty years ago such detergent powders were soap powders, having been made from a mixture of soap and builder salts, often carbonates and silicates. With the large scale introduction of synthetic organic detergents, which replaced soaps because of their superior washing effects in hard waters, without the formation of objectionable soap scum, polyphosphate builder salts, which were exceptionally effective builders for the anionic detergents, such as the higher fatty alcohol sulfates and the alkylaryl sulfonates, were employed, almost to the exclusion of carbonates and silicates. However, some of the anionic detergents foam excessively, and controlled foaming nonionic detergents, which are also excellent cleaners, have recently won increased consumer acceptance. Also, because of ecological and environmental reasons, phosphates have been removed from some detergent formulations. Fortunately, carbonates, bicarbonates and silicates have proven to be effective builders for nonionic detergents and they have been found to be environmentally acceptable.

A preferred way to manufacture particulate detergent products is by spray drying aqueous dispersions of detergent and inorganic builder salts to form beads. These are less dusty, more uniform, freer flowing and more attractive than granulated products. However, unlike most anionic detergents, nonionic detergents do not spray dry well from crutcher mixes containing more than 2 or 3% of the nonionic compound unless there is present in the slurry a special additive. Accordingly, it has been found desirable to spray essentially inorganic salt base beads and then to post-spray onto the surfaces of such beads, which are desirably of such formulation and made by such method as to be ultra-absorbent, a nonionic detergent, in liquid state, so that it may be readily absorbed by the bead. When appreciable quantities of polyphosphates, such as pentasodium tripolyphosphate or tetrasodium pyrophosphate, are present in the crutcher slurry, little difficulty is encountered with premature gelation or setting of the slurry in the crutcher. Also, the problem may be decreased due to the presence of significant quantities of essentially insoluble and non-ionizing inorganic materials, such as kaolins and zeolites (synthetic or natural), and in some cases, certain filler or diluent salts. However, it has been found that when the crutcher slurries or mixes consist essentially of water soluble bicarbonate, carbonate and silicate, partially dissolved and partially dispersed in an aqueous medium at a relatively high inorganic salt concentration, as in the present mixes, there is a tendency for the crutcher slurry to freeze, sometimes almost instantaneously, upon incorporation of the silicate (the silicate is normally added as an aqueous solution, in which form it is commercially supplied). In an effort to overcome this problem, many crutching techniques have been experimentally tested, variations of operating conditions have been tried and many additives have been employed. Yet, after many unsuccessful attempts, the first significant breakthrough was this invention, the discovery that citric acid or soluble citrates, in minor proportions, could drastically modify the gelation characteristics of aqueous slurries of soluble carbonate-bicarbonate-silicate mixtures. Thereby, the gelation of such mixtures could be delayed sufficiently long so that the contents of a crutcher could be pumped out and spray dried, without a portion of the crutcher slurry freezing in the crutcher, pumping lines, the pump, spray drying lines and spray drying nozzles.

In accordance with the present invention, gelation or setting of a miscible and pumpable crutcher slurry containing a substantial proportion of solids in an aqueous medium, which solids content includes significant proportions of sodium bicarbonate, sodium carbonate and sodium silicate, is prevented or retarded by the incorporation in such a crutcher slurry of a small proportion of citric acid, water soluble citrate or mixture thereof. More particularly and preferably, a method of retarding or preventing the gelation of a miscible and pumpable crutcher slurry containing, by weight, from 40 to 70% of solids and 60 to 30% of water, of which solids content, on a 100% solids basis, 55 to 85% is sodium bicarbonate, 5 to 20% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:sodium silicate being within the range of 1:3 to 3:1, comprises preparing at a temperature in the range of 40° C. to 70° C. a crutcher slurry of the described composition containing a gelation preventing proportion, from 0.1 to 2%, of a material selected from the group consisting of citric acid, water soluble citrates and mixtures thereof, and mixing such composition in the crutcher during preparation and thereafter. The invention also relates to the invented crutcher mix, a spray drying method which includes the making of the crutcher mix containing the citric acid and/or citrate, and the particulate base beads resulting, which are suitable for nonionic detergent absorption to make a free flowing particulate heavy duty synthetic organic detergent product.

It is recognized that citric acid and citrates have been recommended as constituents of synthetic organic detergent compositions because of their sequestering effects, especially with respect to trace metals. In the text *Soluble Silicates, Their Properties and Uses*, Volume II: Technology, by James G. Vail, published in the American Chemical Society Monograph Series by Reinhold Publishing Corporation in 1952, at pages 97, 121, 362 and 489, employments of citric acid or sodium citrate with carbonates and silicates in various applications are mentioned, but none of these relates to detergent base bead crutcher mixes of the present type nor does any relate to additions of citrate or citric acid to bicarbonate-carbonate-silicate slurries. Although citric acid has been added previously in synthetic organic detergent composition crutcher mixes, so far as is known to the present inventor such additions were for end use effects of the citric acid or citrate, and were not to crutcher slurries that would have gelled or set in the crutcher if not for the presence of the citric acid or citrate.

While it is considered that the present invention may have application to the making of miscible, flowable and pumpable crutcher slurries of other types than bicarbonate-carbonate-silicate-water mixes, such as slurries also containing synthetic zeolite or polyphosphate builder salts, e.g., hydrated zeolite 4A and/or pentasodium tripolyphosphate, the most significant effects of the citric acid or water soluble citrate in preventing or retarding gelation and setting of crutcher slurries is with respect to those containing about 40 to about 70% of solids and of about 60 to about 30% of water, with the solids content, on a 100% solids basis, being about 55 to about 85% of sodium bicarbonate, about 5 to about 20% of sodium carbonate and about 5 to about 25% of sodium silicate of $Na_2O:SiO_2$ ratio within the range of 1:1.6 to 1:3. In such compositions the ratio of sodium bicarbonate:sodium carbonate is within the range of about 2:1 to about 8:1 and the ratio of sodium carbonate:sodium silicate is within the range of about 1:3 to about 3:1. The proportion of citric acid, water soluble citrate, mixture of such citrates or mixture of citric acid and such citrate(s) will be from about 0.1 to about 2% of the total crutcher mix, including the mentioned salts, water and any adjuvants present.

Preferably, the crutcher slurry contains from 50 to 65% of solids, with the balance being water, and of the solids content, 60 to 80% is sodium bicarbonate, 10 to 20% is sodium carbonate and 10 to 25% is sodium silicate, with the ratio of sodium bicarbonate:sodium carbonate being within the range of 3:1 to 6:1 and the ratio of sodium carbonate:sodium silicate being within the range of 1:2 to 2:1. More preferably the crutcher slurry contains from 50 to 60% of solids, the balance being water, and of the solids content, 60 to 75% is sodium bicarbonate, 10 to 20% is sodium carbonate and 10 to 25% is sodium silicate, with the bicarbonate:carbonate ratio being within the range of 4:1 to 5:1 and the carbonate:silicate ratio being within the range of 1:2 to 1.5:1. The materials described above, except for water, are all normally solid, and the percentages and ratios are on an anhydrous basis, although the materials may be added to the crutcher as hydrates, or dissolved or dispersed in water. Normally, however, the sodium bicarbonate is anhydrous and the sodium carbonate is soda ash. Yet, the carbonate monohydrate may also be employed. The silicate is usually added to the crutcher slurry as an aqueous solution, normally of 40 to 50% solids content, e.g., 47.5% and is preferably added near the end of the mixing process and after previous addition and dispersing and dissolving of the citric acid and/or citrate. The silicate employed will preferably be of $Na_2O:SiO_2$ ratio within the range of 1:2 to 1:2.6, more preferably 1:2.3 to 1:2.5, and most preferably will be 1:2.4 or about such ratio.

Although it is highly preferred to make the crutcher slurry and the base bead product of this invention (from which a heavy duty built nonionic synthetic organic detergent composition can be produced) of essentially inorganic salts, in such manner that they will be of bead properties that promote absorption through the bead surfaces of nonionic detergent sprayed thereon in liquid form, and although often the adjuvants, such as perfumes, colorants, enzymes, bleaches and flow promoting agents, may be sprayed onto the beads with the nonionic detergent or may be post-added, for stable and normally solid adjuvants, mixing in with the inorganic salt slurry in the crutcher may be feasible. Thus, it is contemplated that from 0 to as much as 20% of the crutcher slurry may be of suitable adjuvants or diluents (diluents include inorganic salts, such as sodium sulfate and sodium chloride). However, if such adjuvants are present, normally the proportion thereof will be from 0.1 to 10% and often their content will be limited to 5%, and sometimes to 1 or 2%.

Although this invention relates primarily to preventing gelation and setting of crutcher mixes which are essentially composed of sodium bicarbonate, sodium carbonate and sodium silicate, as described, the benefits of gelation prevention, to a lesser extent when the problem is less severe, may also be obtained when insoluble particulate materials, such as hydrated sodium zeolites, e.g., zeolite 4A, Zeolite X and Zeolite Y, hydrated with from 5 to 22 percent of water per mol, are employed in a proportion up to 50% of the solids content of the crutcher mix, with the proportions of sodium bicarbonate and sodium carbonate and sodium silicate being within the ranges previously given. Similarly, when pentasodium tripolyphosphate is present up to such proportion of solids content of the crutcher mix or when other polyphosphates are substituted for it, in whole or in part, or when such is/are mixed with zeolite(s), viscosity improvement may be obtained. In such cases, when either the zeolite or polyphosphate or a mixture thereof is present, with the total of zeolite and phosphate not exceeding half the solids content of the crutcher mix, improved fluidity of the mix can be useful. Normally, when zeolite and/or polyphosphate and/is present, the proportion thereof will be from 5 to 50% or 10 to 35% of the solids content of the crutcher slurry.

The gelation preventing material employed, which has been found to be startlingly successful in preventing gelation, thickening, setting and freezing up of the crutcher slurry before it can be emptied from the crutcher and spray dried, using normal crutching, pumping and spray drying equipment, is citric acid, water soluble citrate, a mixture of such water soluble citrates or a mixture of citric acid and such water soluble citrate(s). Because the crutcher slurry, including both dissolved and dispersed inorganic salts, is alkaline, normally being of a pH in the range of 9 to 11 or 12, when the citric acid is added to such mixture (normally before addition of the silicate) it is considered to be ionized and converted to the corresponding sodium salt, or at least is quickly brought into equilibrium with the ions thereof. Thus, other soluble citrates may be employed instead of the citric acid, although for many applications the acid is considered to be superior. In addition to sodium citrate, potassium citrate is also useful and ammonium citrate is operative, although in some cases a slight ammoniacal odor released may be objectionable. Instead of adding citrate a mixture of the acid and a neutralizing agent, e.g., NaOH, may be used, and instead of the acid form, citrate plus acid, e.g., HCl, can be substituted, if desired.

The proportion of citric acid or corresponding citrate employed will normally be only sufficient to accomplish the gelation preventive task in the particular crutcher slurry to be treated. However, for safety's sake an excess, e.g., +5 to 20% of the sufficient quantity, may be employed. While it is possible to use as much as 5% of citric acid or citrate or mixture of retard gelation, on a crutcher contents weight basis, usually from 0.1 to 2% will suffice, preferably 0.2 to 1.5% and more preferably 0.2 to 0.5%. When employing the citrate one may wish to increase the percentage of the additive slightly to compensate for the presence of the heavier cation but for simplicity's sake the ranges of proportions of additives given apply to both the acid and salt forms.

The order of addition of the various components to the crutcher is not considered to be critical, except that it is highly desirable to add the silicate solution last, and if not last, at least after the addition of the gel preventive material. Still, in some instances the silicate may be pre-mixed with the additive and in other cases the additive may be admixed in with the other crutcher composition constituents shortly after the rest of the composition. Normally, during the making of the crutcher mix some water will be added to the crutcher, followed by some salt, more water and more salt, and then, gel preventive and silicate, but dispersion-solutions of the individual components may be made beforehand, if feasible. The water employed may be city water of ordinary hardness. In theory it is preferable to utilize deionized water or distilled water, if available, because some metallic impurities in the water may have a triggering action on gel formation, but that is not necessary.

Normally, to promote solution of the water soluble salt in the aqueous medium of the crutcher slurry, the temperature thereof is elevated, usually to the 40° to 70° C. range, and in that range the temperature will often be from 50° to 60° C. Heating promotes dissolving of the salts and thinning of the slurry and adds energy to the slurry so as to facilitate subsequent drying thereof. Crutcher mixing times to obtain good slurries can vary, from as little as ten minutes for small crutchers and slurries of higher moisture contents, to as much as four hours, in some cases, and such might depend on the drying tower throughput rate and comparative size. However, crutching times will normally be from twenty minutes to an hour, e.g., thirty minutes. By the method of this invention gelation and setting of the mix can be delayed up to 15 minutes, 30 minutes, an hour, two hours or four hours, depending on the circumstances. Thus, for example, mixing may be continued for at least 15 minutes after completion of the making at 40° C. to 70° C. of the crutcher slurry containing the gelation preventive of this invention.

The crutched slurry, with salt particles uniformly distributed therein, in part due to the desirable effects of the presence of the citric acid or citrate, is transferred in the usual manner to a spray drying facility, usually located adjacent to the crutcher. Thus, the slurry is dropped from the crutcher to a positive displacement pump, which forces it at high pressure through spray nozzles in a conventional countercurrent (or concurrent) spray tower, wherein droplets of the slurry fall through hot drying gas (usually fuel oil combustion products) and are dried to desired absorptive bead from. During such drying, due to the high temperatures encountered, part of the bicarbonate is converted to carbonate, with the release of carbon dioxide, which appears to improve the physical characteristics of the beads made so that they are more absorptive of liquid nonionic detergent to be post sprayed onto them subsequently.

After drying in the drying gas, which ranges in temperature from about 600° to 100° C. in passage through the tower, the product is screened to desired size, e.g., 10 to 100 mesh, U.S. Standard Sieve Series, and is ready for application of nonionic detergent spray thereto, with the beads being either in warm or cooled (to room temperature) condition. The nonionic detergent, applied to the tumbling beads in known manner, is preferably a condensation product of ethylene oxide and higher fatty alcohol, with the higher fatty alcohol being of 10 to 20 carbon atoms, preferably of 12 to 16 carbon atoms, and with the nonionic detergent containing from about 3 to 20 ethylene oxide groups per mol, preferably from 6 to 12. The proportion of nonionic detergent in the final product will usually be from 10 to 25%, such as from 15 to 22%. However, other proportions may also be employed, as desired, depending on the end use of the product. A preferred finished product formulation contains 15 to 22% of the nonionic detergent (e.g., Neodol® 23-6.5, made by Shell Chemical Company), 30 to 40% of sodium bicarbonate, 20 to 30% of sodium carbonate, 5 to 15% of sodium silicate of $Na_2O:SiO_2$ ratio of 1:2.4, 2% of a fluorescent brightener, 1% of proteolytic enzyme, sufficient bluing to color the product as desired, 0.5 to 3% of moisture and 0.2 to 4% of sodium citrate. Optionally sodium sulfate may be present, as a diluent. The base beads made, devoid of nonionic detergent and adjuvants, will preferably comprise from 35 or 40 to 60% of sodium bicarbonate, 20 or 25 to 45% of sodium carbonate, 10 to 20% of sodium silicate, 0.2 to 4% of sodium citrate, 0 to 10% of adjuvant(s) and/or diluent(s) and 1 to 10% of moisture. In such products the proportion of sodium bicarbonate to sodium carbonate will normally be within the range of 1.2 to 2.4.

The exceptionally beneficial result of incorporation of the small percentages of citric acid and/or citrate in the crutcher slurry in accordance with this invention allows the commercialization of the described product because it facilitates manufacture without the economically disastrous downtimes and cleanups otherwise associated with premature gelation and setting of the crutcher slurry. The mechanism for the setting is not completely understood but it appears to relate to the presence of silicate with the bicarbonate-carbonate mixture. Although it is conceivable that such premature setting could be avoided by modifications of the proportions of bicarbonate, carbonate and silicate, and changing of the type of silicate, such modifications could adversely affect the properties of the heavy duty detergent to be made and accordingly, have been resisted. Instead, with the present invention, at little expense and without any detrimental effects on the product, the desired proportions of the builder salts can be employed and variations in such proportions can be made, as indicated by particular conditions, without fear of freeze-ups in the crutcher. Tests of the final product show no adverse effects due to the presence of the citrate therein and in fact, some positive results, due to metal ion sequestration, might even have been obtained. It is considered that practice of this invention promotes maintenance of the stability of perfumes and colors present and may help to prevent the development of malodors from deteriorations of organic additives, such as proteolytic enzymes and proteinaceous materials.

The presence of citrates in the base beads also has the desirable effect of having the gelation preventing material present in any base beads or detergent beads being reworked, so that such material, if off-specification (as for being undersize), may be mixed with water and made into a thicker rework mix for subsequent blending back with the regular crutcher mix easier than in the case were the citrate not present therein to prevent or retard gelation or excessive thickening.

The following examples illustrate but do not limit the invention. Unless otherwise indicated, all temperatures are in °C. and all parts are by weight in the examples and throughout the specification.

EXAMPLE 1

285 Parts of deionized, distilled water, 8 parts of anhydrous citric acid, 260 parts of sodium bicarbonate and 56 parts of soda ash (natural) were mixed together in a mixing vessel, with the temperature being maintained at about 50° C. To this mixture were added, with stirring, 189 parts of a 47.5% solids content aqueous solution of sodium silicate, of $Na_2O:SiO_2$ ratio of 1:2.4. Mixing of the slurry resulting was continued for 1½ hours, after which time the experiment was terminated, without any indication of gelation, settling or freezing of the slurry in the mixing vessel. When the approximately 1% citric acid content of the slurry is varied to 0.5% and 1.5%, similar desirable gelation preventing effects obtain over times from one hour to four hours. In place of citric acid, sodium citrate dihydrate was also employed at concentrations of 0.5% and 1% in this formula in the mixing vessel, with essentially the same results.

Products which are then spray dried from such mixtures in a spray tower with drying air at a high temperature in the range of 400° to 600° C., are satisfactory bases for absorption of liquid nonionic detergent (Neodol 23-6.5) so that it constitutes 20% by weight of the final product. Such spray dried detergents manufactured are satisfactory heavy duty laundry detergents, possess sequestering effects with respect to trace contents of heavy metals and remove such heavy metals from detrimental interactions with decomposable constituents of detergent formations, such as those which additionally include about 0.5% of perfume materials, such as essential oils, aldehydes and ketones. In the resulting detergent products the ratio of sodium bicarbonate to sodium carbonate is less than that charged to the crutcher, being reduced to about 2.1, due to conversion of the bicarbonate to carbonate during the drying operation.

When potassium citrate and/or ammonium citrate is/are substituted for all or part of the citric acid or sodium citrate in the above example, corresponding gelation retradation is obtained. Similarly, when the porportions of components are changed, for example ±10%, ±20% and ±30%, for each of the bicarbonate, carbonate and silicate, individually, with the citric acid content being varied from 0.2% to 2%, gelation retardation results, for periods of time sufficient to allow emptying of a crutcher and spray drying of the batch, without objectionable thickening or gelation of the crutcher slurry. Similarly, when the silicate is changed to somewhat different types, of $Na_2O:SiO_2$ ratio of 1:1.6 and 1:2.6, gelation retardation results. The above formulas, without the mentioned additive, solidify objectionably within relatively short periods of time, sometimes instantly, upon addition of only a portion of the sodium silicate solution (or other silicates in particulate solid form), and cannot be pumped or sprayed in such state.

EXAMPLE 2

| | Parts by Weight |
|---|---|
| Water | 222.0 |
| Sodium bicarbonate | 290.9 |
| Soda Ash | 64.6 |
| Sodium silicate solution (47.5% solids content, $Na_2SiO_2$ = 1:2.4) | 120.7 |

To a series of six mixtures of water, sodium bicarbonate and soda ash of the above formula are added respectively, 1.74 parts of citric acid, 1.74 parts of ethylenediamine tetraacetic acid, 1.74 parts of tartaric acid, 2.40 parts of oxalic acid dihydrate, 1.74 parts of glycolic acid and 1.74 parts of adipic acid. Then, to each of the crutcher mixes the formula amount of sodium silicate solution is added. In the case of the mix containing citric acid, gelation was retarded for about two hours, but in each of the other cases the crutcher mix became objectionably thick, even during the addition of the sodium silicate. These experiments indicate the unexpected nature of the present invention.

EXAMPLE 3

31.7 Parts of distilled deionized water, 41.6 parts of sodium bicarbonate (industrial grade), 9.2 parts of nautral soda ash and 0.25 part of citric acid (interchangeably, sodium citrate) are mixed together at a temperature of about 50° C. and to such mixture, while being crutched in a conventional detergent crutcher, there are added 17.2 parts of aqueous sodium silicate of $Na_2O:SiO_2$ ratio of 1:2.4, which is 47.5% sodium silicate and 52.5% water. The mix does not thicken objectionably upon addition of the sodium silicate solution, although in the absence of the citric acid (or sodium citrate) or similar gelation preventive material of this invention, the composition gels and sets upon addition of the silicate. Agitation is continued for two hours, during which time, after an initial mixing period of twenty minutes, the crutcher is pumped out to a spray drying tower and is sprayed to absorptive base bead form of higher carbonate content proportionately than the crutcher mix. The spray drying is effected in a countercurrent tower with the drying inlet temperature at about 425° C. and the dried beads are screened to desired 10 to 100 mesh, U.S. Standard Sieve Series, size. Then, sufficient nonionic detergent (Neodol 23-6.5) in liquid form (heated to about 50° C.) is sprayed onto the beads to produce a product containing about 20% of the nonionic detergent, 35% of sodium bicarbonate, 25% of sodium carbonate, 10% of sodium silicate, 2% of moisture, and 0.5% of sodium citrate, with the balance of adjuvants, etc. The product is an excellent heavy duty laundry detergent of the controlled foam type. In modifications of the process, small percentages of adjuvants are also present in the crutcher mix, for example, 2% of fluorescent brightener and 0.5% of pigment, on a final product basis. Also, when potassium citrate is substituted for the sodium salt similar gelation prevention will result and the use of the potassium salt might even be preferable because of its greater solubility and the absence of additional sodium ions added to the crutcher.

Although no problems are experienced in crutching and transferring the treated slurry, when the same experiment is repeated without the citric acid or equivalent gelation preventive material of this invention being present the composition solidifies in the crutcher, or at the best becomes so thick as to be unworkable or very difficultly workable. Such objectionable slurry, even if it can be pumped, causes blockages in the lines and in the spray nozzles and interferes seriously with commercial production.

When, usually because of failures to meet particle size specifications, base beads of this example have to be reworked, no problems are experienced with the rework setting up in the crutcher. However, reworked beads without the gelation preventive additive being present do cause such problems, even after having been made with great difficulty.

While the improvement in perfume aroma in the presence of the present citrates may be considered subjective, when heavy metal impurities, such as iron, are present in the crutcher mix, the sequestration thereof by the citrate does appear to help stabilize the perfume of the detergent, depending, of course, to some extent, on the particular type of perfume and its delicacy of aroma.

The invention has been described with respect to various illustrative examples and embodiments thereof but is not to be limited to these because it is evident that one of skill in the art, with the present teaching before him, will be able to utilize substitutes and equivalents without departing from the invention.

What is claimed is:

1. A method of retarding or preventing the gelation of a miscible and pumpable crutcher slurry containing, by weight, from 40 to 70% of solids and 60 to 30% of water, of which solids content, on a 100% solids basis, 55 to 85% is sodium bicarbonate, 5 to 20% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:-sodium silicate being within the range of 1:3 to 3:1, which comprises preparing at a temperature in the range of 40° C. to 70° C. a crutcher slurry of the described composition containing a gelation preventing proportion, from 0.1 to 2%, of a material selected from the group consisting of citric acid, water soluble citrates and mixtures thereof, and mixing such composition in the crutcher during preparation and thereafter.

2. A method according to claim 1 wherein the crutcher slurry contains from 50 to 65% of solids and 50 to 35% of water, of which solids content 60 to 80% is sodium bicarbonate, 10 to 20% is sodium carbonate and 10 to 25% is sodium silicate of $Na_2O:SiO_2$ ratio within the range of 1:2 to 1:2.6, the ratio of sodium bicarbonate:sodium carbonate is within the range of 3:1 to 6:1 and the ratio of sodium carbonate:sodium silicate is within the range of 1:2 to 2:1, and wherein the percentage of gelatin preventing citric acid and/or water soluble citrate in the crutcher slurry is from 0.2 to 1.5.

3. A method according to claim 2 wherein the crutcher slurry is prepared at atmospheric pressure, and the gelation preventive is incorporated in the slurry before addition thereto of at least some of the sodium silicate.

4. A method according to claim 3 wherein the crutcher slurry contains from 50 to 60% of solids and 50 to 40% of water, of which solids content 60 to 75% is sodium bicarbonate, 10 to 20% is sodium carbonate and 10 to 25% is sodium silicate of $Na_2O:SiO_2$ ratio of about 1:2.4, the ratio of sodium bicarbonate:sodium carbonate is within the range of 4:1 to 5:1 and the ratio of sodium carbonate:sodium silicate is within the range of 1:2 to 1.5:1, and wherein the percentage of gelation preventive in the crutcher slurry is from 0.2 to 0.5 and such is added to the slurry before addition thereto of the sodium silicate, which is added in an aqueous solution of 40 to 50% solids content.

5. A method according to claim 1 wherein mixing is continued for at least 15 minutes after completion of the making of the crutcher slurry containing said gelation preventive.

6. A method according to claim 4 wherein the crutcher slurry temperature is from 50° to 60° C. and the mixing is continued for at least one-half hour after completion of the crutcher slurry, during at least a portion of which period at least part of the crutched mix is pumped out of the crutcher to a spray drying tower and is spray dried therein.

7. A method according to claim 4 wherein citric acid is the gelation preventing material in the crutcher slurry.

8. A method according to claim 4 wherein sodium citrate is the gelation preventing material in the crutcher slurry.

9. A method according to claim 1 wherein citric acid is the gelation preventing material in the crutcher slurry.

10. A method according to claim 1 wherein sodium citrate is the gelation preventing material in the crutcher slurry.

11. A method according to claim 1 wherein from 0.1 to 10% of the crutcher slurry is of adjuvant(s) and/or diluent(s).

12. A miscible and pumpable crutcher slurry comprising, by weight from 40 to 70% of solids and 60 to 30% of water, of which solids content, on a 100% solids basis, 55 to 85% is sodium bicarbonate, 5 to 20% is sodium carbonate and 5 to 25% is sodium silicate of $Na_2O:SiO_2$ ratio within the range of 1:1.6 to 1:3, with the ratio of sodium bicarbonate:sodium carbonate being within the range of 2:1 to 8:1 and the ratio of sodium carbonate:sodium silicate being within the range of 1:3 to 3:1, and a gelation preventing proportion, from 0.1 to 2%, of a material selected from the group consisting of citric acid, water soluble citrates and mixtures thereof.

13. A crutcher slurry according to claim 12 comprising 50 to 65% of solids and 50 to 35% of water, of which solids content 60 to 80% is sodium bicarbonate, 10 to 20% is sodium carbonate and 10 to 25% is sodium silicate of $Na_2O:SiO_2$ ratio within the range of 1:2 to 1:2.6, with the ratio of sodium bicarbonate:sodium carbonate being within the range of 3:1 to 6:1 and the ratio of sodium carbonate:sodium silicate being within the range of 1:2 to 2:1, and wherein the percentage of gelation preventing material is from 0.2 to 1.5.

14. A crutcher slurry according to claim 13 containing from 50 to 60% of solids and 50 to 40% of water, of which solids content 60 to 75% is sodium bicarbonate, 10 to 20% is sodium carbonate and 10 to 25% is sodium silicate of $Na_2O:SiO_2$ ratio of about 1:2.4, the ratio of sodium bicarbonate:sodium carbonate is within the range of 4:1 to 5:1 and the ratio of sodium carbonate:-sodium silicate is within the range of 1:2 to 1.5:1, and the percentage of gelation preventing material is from 0.2 to 0.5.

15. A crutcher slurry according to claim 14 containing in addition from 0.1 to 10% of adjuvant(s) and/or diluent(s).

16. A method of making a particulate base material in bead form, suitable for absorbing nonionic detergent to make a built heavy duty synthetic organic detergent composition, which comprises making a miscible and pumpable crutcher slurry in a crutcher by the method of claim 1, pumping the slurry out of the crutcher in ungelled and ready pumpable state and spray drying the slurry to particulate bead form, during which spray drying a portion of the sodium bicarbonate is converted to sodium carbonate.

* * * * *